US005682094A

United States Patent [19]

Beier et al.

[11] Patent Number: 5,682,094

[45] Date of Patent: Oct. 28, 1997

[54] CURRENT MIRROR ARRANGEMENT

[75] Inventors: Ralf Beier; Axel Näthe, both of Hamburg, Germany

[73] Assignee: U.S. Philips Corporation, New York, N.Y.

[21] Appl. No.: 692,146

[22] Filed: Aug. 5, 1996

[30] Foreign Application Priority Data

Aug. 8, 1995 [DE] Germany ..... 195 29 059.3

[51] Int. Cl.[6] ..... G05F 3/20

[52] U.S. Cl. ..... 323/315; 323/312

[58] Field of Search ..... 323/312, 315; 330/288; 327/530, 538

[56] References Cited

U.S. PATENT DOCUMENTS

| | | | |
|---|---|---|---|
| 3,813,607 | 5/1974 | Voorman | 330/17 |
| 3,952,257 | 4/1976 | Schade, Jr. | 330/22 |
| 4,045,694 | 8/1977 | Ahmed | 307/296 R |
| 4,260,945 | 4/1981 | Ahmed | 323/316 |
| 4,525,682 | 6/1985 | Lai et al. | 330/288 |
| 4,525,683 | 6/1985 | Jason | 330/288 |
| 4,771,228 | 9/1988 | Hester et al. | 323/315 |
| 4,814,724 | 3/1989 | Tanigawa | 330/288 |
| 4,952,866 | 8/1990 | Van Tuijl | 323/315 |
| 4,961,046 | 10/1990 | De Jager | 323/315 |
| 5,293,112 | 3/1994 | Takahashi | 323/315 |
| 5,311,146 | 5/1994 | Brannon et al. | 330/288 |

FOREIGN PATENT DOCUMENTS

| | | | |
|---|---|---|---|
| 0173367 | 11/1990 | European Pat. Off. . | |
| 3114877C2 | 2/1982 | Germany | H03F 3/04 |
| 60-165112A | 8/1985 | Japan . | |

*Primary Examiner*—Adolf Berhane

*Attorney, Agent, or Firm*—Bernard Franzblau

[57] ABSTRACT

A current mirror arrangement comprising at least one input transistor of a first conductivity type, whose emitter is connected to a current supply line and whose collector is arranged to carry an input current. At least one output transistor of the first conductivity type has its emitter connected to the current supply line and its base to the base of the input transistor and from whose collector an output current can be taken. A follower transistor of the first conductivity type has its emitter connected to the bases of the input transistor and the output transistor and its base to the collector of the input transistor, and has its collector coupled to a reference potential. In order to ensure a well-defined load of the current supply line in any operating condition, the current mirror arrangement also includes a control transistor of a second conductivity type opposite to the first conductivity type. The control transistor has its collector connected to the collector of the input transistor and its emitter to the reference potential via an emitter current source. The base of the control transistor is arranged to receive a control voltage for controlling the output current. The collector of the follower transistor is coupled to the reference potential via a resistor. A further transistor of the second conductivity type has its emitter connected to the emitter of the control transistor, its base to the collector of the follower transistor, and its collector to the current supply line.

4 Claims, 1 Drawing Sheet

CURRENT MIRROR ARRANGEMENT

Current mirror arrangement

The invention relates to a current mirror arrangement comprising at least one input transistor of a first conductivity type, whose emitter is connected to a current supply line and whose collector is arranged to carry an input current, at least one output transistor of the tint conductivity type, having its emitter connected to the current supply line and its base to the base of the input transistor and from whose collector an output current can be taken, and a follower transistor of the first conductivity type having its emitter connected to the bases of the input transistor and the output transistor and its base to the collector of the input transistor, and having its collector coupled to a reference potential.

The follower transistor then serves to take up the base currents of the input transistor and the output transistor in such a manner that only a minimal portion of these base currents influences the ratio between the input current and the output current.

Figure 2:
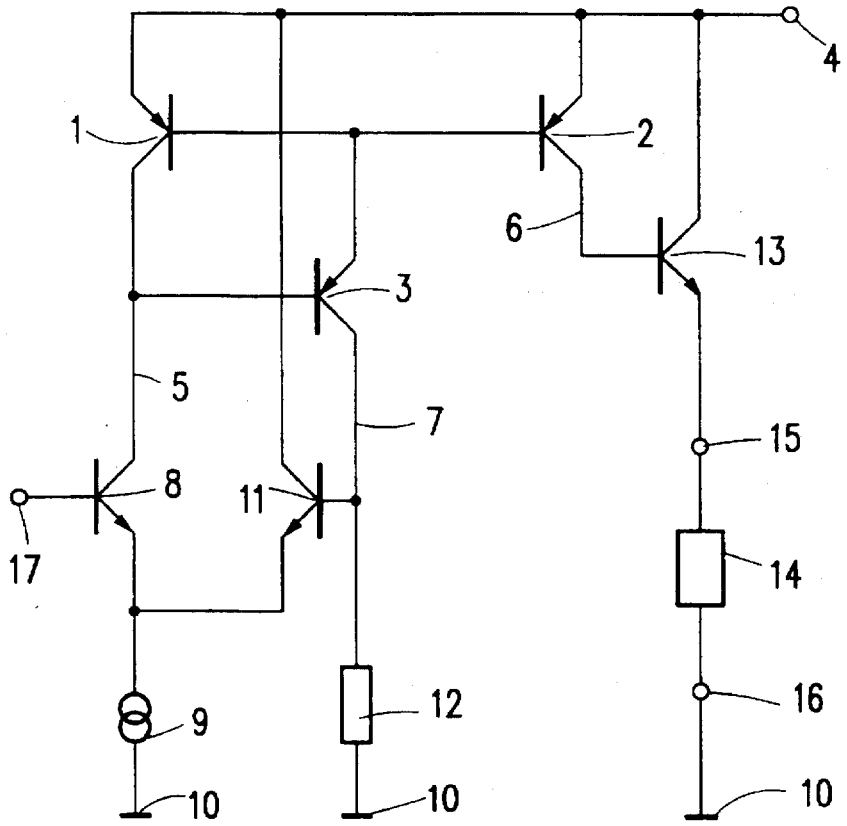

Such a circuit arrangement is known from DE-PS 31 14 877. In FIG. 2 in said document the input current is produced by a current source, whereas the output current is taken via a load.

Therefore, in normal operation of this circuit arrangement, with the load connected to the output transistor, not only the input current and the output current are taken from the current supply line but also the current in the follower transistor, which is a factor equal to the current gain of one of the transistors of the first conductivity type as small as the sum of the input current and the output current. Since this current gain may vary under the influence of different production and operating parameters, the current through the follower transistor and hence the load presented to the current supply line are subject to a substantial spread.

If the load is disconnected from the output transistor, resulting in no-load operation of the current mirror arrangement, this leads to an even more unfavorable situation. In this operating condition the current mirror ratio between the input current and the output current is no longer met. Since now only very small currents flow in the input transistor, the output transistor assumes a state of saturation in which a current which corresponds substantially to the overall current in the follower transistor flows from the current supply line into the follower transistor via the emitter and the base of the output transistor. If now a given input current is taken from the connection between the collector of the input transistor and the base of the follower transistor this current will be divided into a component through the collector of the input transistor and a component through the base of the follower transistor.

The current component through the base of the follower transistor then becomes so large that the resulting current through the emitter of the follower transistor and the base of the output transistor produces at the output transistor a base-emitter voltage equal to that at the input transistor. In the extreme case the given input current flows almost exclusively through the base of the follower transistor. The current in the follower transistor is then in principle a factor equal to the current gain of one of the follower transistor as large as the input current. This not only results in a substantially higher load of the current supply line in comparison with normal operation but as result of the spread in current gain of the follower transistor, this load will also be subject to a substantial spread in the manner described.

It is an object of the invention to construct a current mirror arrangement of the type defined in the opening paragraph in such a manner that a well-defined load of the current supply line is obtained under all operating conditions.

According to the invention this object is achieved in a current mirror arrangement of the type defined in the opening paragraph by a control transistor of a second conductivity type opposite to the first conductivity type, the control transistor having its collector connected to the collector of the input transistor and its emitter to the reference potential via an emitter current source, a base of the control transistor being arranged to receive a control voltage for controlling the output current, a resistor via which the collector of the follower transistor is coupled to the reference potential, and a further transistor of the second conductivity type, having its emitter connected to the emitter of the control transistor, its base to the collector of the follower transistor, and its collector to the current supply line.

In a current mirror arrangement in accordance with the invention the current through the follower transistor is applied to the reference potential via the resistor instead of directly. In combination with the control transistor and the common emitter-current source the further transistor forms a differential amplifier arrangement which compares the control voltage with voltage produced across the resistor by the current in the follower transistor. When the current through the follower transistor increases to such an extent that the voltage across the resistor exceeds the control voltage, the current of the emitter current source is diverted via the further transistor and is thus taken directly from the current supply line and no longer from the current mirror comprising the input transistor, the output transistor and the follower transistor. As a result, the current via the current mirror is limited. The current taken from the current supply line is now essentially determined by the quotient of the control voltage and the resistance and by the current of the emitter current source. Since these parameters can be defined accurately a well-defined load of the current supply line is obtained in any operating condition. The current from the current supply line then becomes also independent of the supply voltage available on this current supply line.

It is to be noted here, that the laid-open Japanese Patent Application 60-165112 (A) discloses a current mirror arrangement comprising an input transistor, an output transistor and a follower transistor of the pnp type, in which the collector of the follower transistor is connected to ground via a resistor. The emitter of the follower transistor and the bases of the input transistor and the output transistors or output transistors are connected to the collector of a transistor whose base is connected to the collector of the follower transistor and whose emitter is connected to ground. In this known circuit arrangement the transistor takes over part of the emitter current of the follower transistor in order to reduce the base current of the follower transistor. This is obviously in order to increase the accuracy of the current mirror ratio of the known current mirror arrangement even in the case of a plurality of output transistors and, as a consequence, a larger current in the follower transistor. However, as both the follower transistor and the additional transistor draw their currents from the bases of the input transistor and the output transistor, this does not eliminate the afore-mentioned spreads of the currents from the current supply line.

In an advantageous embodiment the current mirror arrangement in accordance with the invention comprises an output stage transistor of the second conductivity type, having its collector connected to the current supply line and its base to the collector of the output transistor, and whose emitter is arranged to be coupled to a load. This output-stage transistor relieves the output transistor from the current through the load.

In the current mirror arrangement in accordance with the invention the first conductivity type is preferably the pnp type and the second conductivity type the npn type of bipolar transistors. The input, output and follower transistors are then of the pnp type. Bipolar pnp transistors frequently have a lower current gain than npn transistors, so that their base currents are comparatively larger and therefore lead to larger deviations in current mirrors but also to higher loads of, particularly, the follower transistor. The use of this conductivity type is therefore advantageous for the invention but an opposite choice of conductivity types is also possible.

An embodiment of the invention will now be described in more detail, by way of example, with reference to the drawing. In the drawing FIG. 1 shows a prior-art current mirror arrangement, FIG. 2 shows a current mirror arrangement in accordance with the invention.

Figure 1:
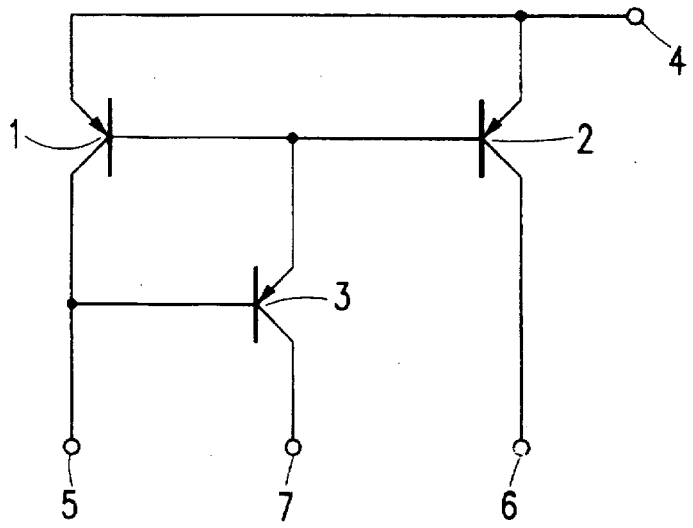
FIG. 1 PRIOR ART

In FIG. 1 an input transistor 1, an output transistor 2 and a follower transistor 3 are of the bipolar pnp type. The input transistor 1 and the output transistor 2 have their emitters connected to a current supply line 4 and their bases to the emitter of the follower transistor 3. The collector of the input transistor 1 is connected to an input terminal 5, the collector of the output transistor 2 to an output terminal 6, and the collector of the follower transistor 3 to a terminal via which a substantial portion of the sum of the base currents of the input transistor 1 and the output transistor 2 is drained.

In FIG. 2, in which corresponding elements bear the same reference numerals, a control transistor 8 has been added to the current mirror arrangement described above, which control transistor has its collector connected to the input terminal 5 and has its emitter connected to ground 10 via an emitter current source 9. A further transistor 11 has its collector connected to the current supply line 4. The further transistor 11 has its base coupled to the terminal 7 and its emitter to the emitter of the control transistor 8. The terminal 7 is also connected to ground 10 via a resistor 12.

Moreover, the collector of the output transistor 2, i.e. the output terminal 6, is connected to the base of an output stage transistor 13, whose collector is connected to the current supply line 4 and whose emitter is coupled to ground 10 via a lead 14. Connection terminals 15 and 16 for the connection of the lead 14 are shown symbolically.

The control transistor 8, the further transistor 11 and the output stage transistor 13 in FIG. 2 are of the npn type, i.e. of a conductivity type opposite to that of the input transistor 1, the output transistor 2 and the follower transistor 3. The output stage transistor 13 is arranged as an emitter-follower for the low-impedance supply of the lead.

In the current mirror arrangement shown in FIG. 2 the emitter current source 9 and the resistor 12 are preferably dimensioned in such a manner in relation to the other parts that in normal operation, i.e. with the load 14 connected, the voltage produced across the resistor 12 by the current in the follower transistor 3 is smaller than a control voltage applied via the base 17 of the control transistor 8. The further transistor 11 is then currentless and does not influence the operation of the current mirror arrangement, i.e. of the input transistor 1 and of the output transistor 2.

If during no-load operation, i.e. after disconnection of the load 14 from the terminals 15 and 16, the current in the follower transistor 3 increases, the voltage across the resistor 12 will exceed the control voltage on the base 17. The current from the emitter current source 9 now flows directly from the current supply line 4 via the further transistor 11. This precludes a further increase of the current in the follower transistor 3 and hence an increase of the current drained from the current supply line 4; instead, the current to be obtained from the current supply line 4 is limited to a well-defined value determined by the current of the emitter current source 9 and the ratio between the control voltage and the resistance of the resistor 12.

The present invention solves the problem posed herein effectively with a very small number of circuit elements.

We claim:

1. A current mirror arrangement comprising:

at least one input transistor of a first conductivity type, whose emitter is connected to a current supply line and whose collector is arranged to carry an input current, at least one output transistor of the first conductivity type, having its emitter connected to the current supply line and its base to the base of the input transistor and from whose collector an output current can be taken, and a follower transistor of the first conductivity type having its emitter connected to the bases of the input Transistors and the output transistor and its base to the collector of the input transistor, and having its collector coupled to a reference potential, characterized by a control transistor of a second conductivity type opposite to the first conductivity type, the control transistor having its collector connected to the collector of the input transistor and its emitter to the reference potential via an emitter current source, a base of the control transistor being arranged to receive a control voltage for controlling the output current, a resistor via which the collector of the follower transistor is coupled to the reference potential, and a further transistor of the second conductivity type, having its emitter connected to the emitter of the control transistor, its base to the collector of the follower transistor, and its collector to the current supply line.

2. A current mirror arrangement as claimed in claim 1, further comprising an output stage transistor of the second conductivity type, having its collector connected to the current supply line and its base to the collector of the output transistor, and whose emitter is arranged to be coupled to a load.

3. A current mirror arrangement as claimed in claim 2, wherein the first conductivity type is the pnp type and the second conductivity type is the npn type.

4. A current minor arrangement as claimed in claim 1, wherein the first conductivity type is the pnp type and the second conductivity type is the npn type.

* * * * *